US008520858B2

(12) United States Patent
Metcalf

(10) Patent No.: US 8,520,858 B2
(45) **Date of Patent: *Aug. 27, 2013**

(54) SOUND SYSTEM AND METHOD FOR CAPTURING AND REPRODUCING SOUNDS ORIGINATING FROM A PLURALITY OF SOUND SOURCES

(75) Inventor: Randall B. Metcalf, Cantonment, FL (US)

(73) Assignee: Verax Technologies, Inc., Pensacola, FL (US)

( * ) Notice: Subject to any disclaimer, the term of this patent is extended or adjusted under 35 U.S.C. 154(b) by 1427 days.

This patent is subject to a terminal disclaimer.

(21) Appl. No.: 11/407,965

(22) Filed: Apr. 21, 2006

(65) Prior Publication Data

US 2006/0262948 A1 Nov. 23, 2006

Related U.S. Application Data

(63) Continuation of application No. 08/749,766, filed on Nov. 20, 1996, now Pat. No. 7,085,387.

(51) Int. Cl.

| | |
|---|---|
| ***H04R 5/00*** | (2006.01) |
| ***H04R 29/00*** | (2006.01) |
| ***H04R 3/00*** | (2006.01) |
| ***H04R 27/00*** | (2006.01) |
| ***H04R 5/02*** | (2006.01) |

(52) U.S. Cl.
USPC ..... 381/28; 381/59; 381/77; 381/84; 381/300

(58) Field of Classification Search
USPC ..... 381/28, 59, 300, 61, 24, 17–19, 303, 381/56, 57, 58, 77, 84
See application file for complete search history.

(56) References Cited

U.S. PATENT DOCUMENTS

| | | | |
|---|---|---|---|
| 257,453 | A | 5/1882 | Ader |
| 572,981 | A | 12/1896 | Goulvin |

(Continued)

FOREIGN PATENT DOCUMENTS

| | | | |
|---|---|---|---|
| EP | 0 593 228 | A | 4/1994 |
| EP | 1 416 769 | | 5/2004 |

OTHER PUBLICATIONS

Berkhout, A. J., et al., "Acoustic Control by Wave Field Synthesis", *J. Acoust. Soc. Am.*, vol. 93, No. 5, May 1993, pp. 2764-2778.

(Continued)

*Primary Examiner* — Duc Nguyen
*Assistant Examiner* — George Monikang
(74) *Attorney, Agent, or Firm* — Pillsbury Winthrop Shaw Pittman LLP

(57) ABSTRACT

A sound system for capturing and reproducing sounds produced by a plurality of sound sources. The system comprises a device for receiving sounds produced by the plurality of sound sources and converting the separately received sounds to a plurality of separate audio signals without mixing the audio signals. The system may further comprise a device for separately storing the plurality of separate audio signals on a recording medium without mixing the audio signals and a device for reading the stored audio signals from the recording medium. The system further includes a reproduction system for recreating the plurality of separate audio signals. Also, the system comprises an amplification network which comprises a plurality of amplifier systems, with one or more separate amplifiers in each amplifier system for separately amplifying each of the separate audio signals. The system also comprises a loudspeaker network which comprises a plurality of loudspeaker systems with one or more separate loudspeakers in each loudspeaker system for separately reproducing the plurality of audio signals. A dynamic controller may be used to control the micro relationships of the components within a signal path and the macro relationships among the separate signal paths. The amplifiers and/or loudspeakers for each signal path may be customized based on the characteristics and complexities of the original sound to be reproduced on each signal path.

22 Claims, 7 Drawing Sheets

(56) References Cited

U.S. PATENT DOCUMENTS

| | | | | |
|---|---|---|---|---|
| 1,765,735 | A * | 6/1930 | Phinney | 369/4 |
| 2,352,696 | A | 7/1944 | De Boer et al. | 381/2 |
| 2,819,342 | A | 1/1958 | Becker | 179/1 |
| 3,158,695 | A | 11/1964 | Camras | 369/91 |
| 3,540,545 | A | 11/1970 | Herleman et al. | 181/31 |
| 3,710,034 | A | 1/1973 | Murry | 360/7 |
| 3,944,735 | A | 3/1976 | Willcocks | 179/1 |
| 4,072,821 | A | 2/1978 | Bauer | 381/23 |
| 4,096,353 | A | 6/1978 | Bauer | 381/21 |
| 4,105,865 | A | 8/1978 | Guillory | 179/1 |
| 4,196,313 | A | 4/1980 | Griffiths | 179/1 M |
| 4,377,101 | A | 3/1983 | Santucci | 84/743 |
| 4,393,270 | A | 7/1983 | Van Den Berg | 381/98 |
| 4,408,095 | A | 10/1983 | Ariga et al. | 381/24 |
| 4,422,048 | A | 12/1983 | Edwards | 330/109 |
| 4,433,209 | A | 2/1984 | Kurosawa et al. | 381/1 |
| 4,481,660 | A | 11/1984 | De Koning et al. | 381/58 |
| 4,675,906 | A | 6/1987 | Sessler et al. | 381/92 |
| 4,683,591 | A | 7/1987 | Dawson et al. | 381/85 |
| 4,782,471 | A | 11/1988 | Klein | 367/168 |
| 5,027,403 | A | 6/1991 | Short et al. | 381/306 |
| 5,033,092 | A | 7/1991 | Sadaie | 381/97 |
| 5,046,101 | A | 9/1991 | Lovejoy | 381/57 |
| 5,058,170 | A | 10/1991 | Kanamori et al. | 381/92 |
| 5,142,586 | A | 8/1992 | Berkhout | 381/63 |
| 5,150,262 | A | 9/1992 | Hosokawa et al. | 360/48 |
| 5,212,733 | A | 5/1993 | DeVitt et al. | 381/119 |
| 5,225,618 | A | 7/1993 | Wadhams | 84/602 |
| 5,260,920 | A | 11/1993 | Ide et al. | 369/5 |
| 5,315,060 | A | 5/1994 | Paroulaud | 84/726 |
| 5,367,506 | A | 11/1994 | Inanaga et al. | 369/4 |
| 5,400,405 | A | 3/1995 | Petroff | 381/1 |
| 5,400,433 | A | 3/1995 | Davis et al. | 704/220 |
| 5,404,406 | A | 4/1995 | Fuchigami et al. | 381/17 |
| 5,452,360 | A | 9/1995 | Yamashita et al. | 381/63 |
| 5,465,302 | A | 11/1995 | Lazzari et al. | 381/92 |
| 5,497,425 | A | 3/1996 | Rapoport | 381/18 |
| 5,506,907 | A | 4/1996 | Ueno et al. | 381/18 |
| 5,506,910 | A | 4/1996 | Miller et al. | 381/103 |
| 5,521,981 | A | 5/1996 | Gehring | 381/17 |
| 5,524,059 | A | 6/1996 | Zurcher | 381/92 |
| 5,627,897 | A | 5/1997 | Gagliardini et al. | 381/71.7 |
| 5,657,393 | A | 8/1997 | Crow | 381/92 |
| 5,740,260 | A * | 4/1998 | Odom | 381/119 |
| 5,768,393 | A | 6/1998 | Mukojima et al. | 381/17 |
| 5,781,645 | A | 7/1998 | Beale | 381/182 |
| 5,790,673 | A | 8/1998 | Gossman | 381/71.1 |
| 5,796,843 | A | 8/1998 | Inagawa et al. | 381/17 |
| 5,809,153 | A | 9/1998 | Aylward et al. | 381/155 |
| 5,812,685 | A | 9/1998 | Fujita et al. | 381/90 |
| 5,822,438 | A | 10/1998 | Sekine et al. | 381/17 |
| 5,850,455 | A * | 12/1998 | Arnold et al. | 381/17 |
| 5,857,026 | A | 1/1999 | Scheiber | 381/23 |
| 6,021,205 | A | 2/2000 | Yamada et al. | 381/310 |
| 6,041,127 | A | 3/2000 | Elko | 381/92 |
| 6,072,878 | A | 6/2000 | Moorer | 381/18 |
| 6,084,168 | A | 7/2000 | Sitrick | 84/477 R |
| 6,154,549 | A | 11/2000 | Arnold et al. | 381/104 |
| 6,219,645 | B1 | 4/2001 | Byers | 704/275 |
| 6,239,348 | B1 | 5/2001 | Metcalf | 84/723 |
| 6,356,644 | B1 | 3/2002 | Pollak | 381/371 |
| 6,444,892 | B1 | 9/2002 | Metcalf | 84/723 |
| 6,574,339 | B1 | 6/2003 | Kim et al. | 381/17 |
| 6,608,903 | B1 | 8/2003 | Miyazaki et al. | 381/17 |
| 6,664,460 | B1 | 12/2003 | Pennock et al. | 84/662 |
| 6,686,531 | B1 | 2/2004 | Pennock et al. | 84/615 |
| 6,738,318 | B1 | 5/2004 | Harris | 369/2 |
| 6,740,805 | B2 | 5/2004 | Metcalf | 84/723 |
| 6,826,282 | B1 | 11/2004 | Pachet et al. | 381/61 |
| 6,829,018 | B2 | 12/2004 | Lin et al. | 348/738 |
| 6,925,426 | B1 | 8/2005 | Hartmann | 703/5 |
| 6,959,096 | B2 | 10/2005 | Boone et al. | 381/152 |
| 6,990,211 | B2 | 1/2006 | Parker | 381/74 |
| 7,138,576 | B2 | 11/2006 | Metcalf | 84/723 |
| 7,206,648 | B2 | 4/2007 | Fujishita | 700/94 |
| 7,289,633 | B2 | 10/2007 | Metcalf | 381/17 |
| 7,383,297 | B1 | 6/2008 | Atsmon et al. | 709/200 |
| 7,572,971 | B2 | 8/2009 | Metcalf | 84/723 |
| 7,636,448 | B2 | 12/2009 | Metcalf | 381/300 |
| 7,994,412 | B2 | 8/2011 | Metcalf | 84/723 |
| 2001/0055398 | A1 | 12/2001 | Pachet et al. | 381/80 |
| 2003/0123673 | A1 | 7/2003 | Kojima | 381/1 |
| 2004/0111171 | A1 | 6/2004 | Jang et al. | 700/94 |
| 2004/0131192 | A1 | 7/2004 | Metcalf | 381/1 |
| 2005/0141728 | A1 | 6/2005 | Moorer | 381/61 |
| 2005/0195998 | A1 | 9/2005 | Yamamoto et al. | 381/119 |
| 2006/0109988 | A1 | 5/2006 | Metcalf | 381/104 |
| 2006/0117261 | A1 | 6/2006 | Sim et al. | 715/727 |
| 2006/0206221 | A1 | 9/2006 | Metcalf | 700/94 |

OTHER PUBLICATIONS

Maynard, J. D., et al., "Nearfield Acoustic Holography: I. Theory of Generalized Holography and the Development of NAH", *J. Acoust. Soc. Am.*, vol. 78, No. 4, Oct. 1985, pp. 1395-1413.

Wittek, "Optimised Phantom Source Imaging of the High Frequency Content of Virtual Sources in Wave Field Synthesis", A Hybrid WFS/Phantom Source Solution to Avoid Spatial Aliasing. Munich, Germany: Institut fur Rundfunktechnik, 2002, pp. 1-10.

Wittek, "Perception of Spatially Synthesized Sound Fields", University of Surrey—Institute of Sound Recording, Guilford, Surrey, UK, Dec. 2003, pp. 1-43.

Young, "Networked Music: Bridging Real and Virtual Space", Peabody Conservatory of Music, Johns Hopkins University, Baltimore, Maryland, 4 pages, Aug. 2001.

"Discretizing of the Huygens Principle", retrieved Jul. 3, 2003, from http://cui.unige.ch/~luthi/links/tlm/node3.htm1, 2 pages.

"The Dispersion Relation", retrieved May 14, 2004, from http://cui.unige.ch/~luthi/links/tlm/node4.html, 3 pages.

Lokki et al., "The DIVA Auralization System", Helsinki University of Technology, pp. 1-4, May. 26-29, 2001.

"Lycos Asia Malaysia—News", Printed on Dec. 3, 2001, from http://livenews.lycosasia.com/my/, 3 pages.

Martin, "Toward Automatic Sound Source Recognition: Identifying Musical Instruments", presented at the NATO Computational Hearing Advanced Study Institute, II Ciocco, Italy, Jul. 1-12, 1998, pp. 1-6.

Melchior et al., "Authoring System for Wave Field Synthesis Content Production", presented at the 115$^{th}$ Convention of the Audio Engineering Society, New York, New York, Oct. 10-13, 2003, pp. 1-10.

Miller-Daly, "What You Need to Know About 3D Graphics/Virtual Reality: Augmented Reality Explained", retrieved Dec. 5, 2003, from http://web3d.about.com/library/weekly/aa012303a.htm, 3 pages.

Muller-Tomfelde, "Hybrid Sound Reproduction in Audio-Augmented Reality", AES 22$^{nd}$ International Conference on Virtual, Synthetic and Entertainment Audio, pp. 1-6, June 15-17, 2002.

Neumann et al., "Augmented Virtual Environments (AVE) for Visualization of Dynamic Imagery", Integrated Media Systems Center, Los Angeles, California, 5 pages, 2003.

"New Media for Music: An Adaptive Response to Technology", *Journal of the Audio Engineering Society*, vol. 51, No. 6, Jun. 2003, pp. 575-577.

Nicol et al., "Reproducing 3D-Sound for Videoconferencing: a Comparison Between Holophony and Ambisonic", France Telecom CNET Lannion, 4 pages, Nov. 1998.

Riegelsberger et al. Advancing 3D Audio Through an Acoustic Geometry Interface, 6 pages, 2000.

"Brains of Deaf People Rewire to 'Hear' Music", *ScienceDaily Magazine*, University of Washington, Nov. 28, 2001, 2 pages.

Smith, "Deaf People Can 'Feel' Music: Might Explain How Some Are Able to Become Performers", retrieved Dec. 3, 2001, from http://my.webmd.com/printing/article/1830.50576, 1 page.

Campos, et al., "A Parallel 3D Digital Waveguide Mesh Model with Tetrahedral Topology for Room Acoustic Simulation", Proceedings of the COST G-6 Conference on Digital Audio Effects (DAFX-00), Verona, Italy, Dec. 7-9, 2000, pp. 1-6.

Caulkins et al., "Wave Field Synthesis Interaction with the Listening Environment, Improvements in the Reproduction of Virtual Sources Situated Inside the Listening Room", Proc. of the 6th Int. Conference on Digital Audio Effects (DAFx-03), London, U.K. Sep. 8-11, 2003, pp. 1-4.
Sontacchi et al., "Enhanced 3D Sound Field Synthesis and Reproduction System by Compensating Interfering Reflections", Proceedings of the COST G-6 Conference on Digital Audio Effects (DAFX-00, Verona, Italy, Dec. 7-9, 2000, pp. 1-6.
Spors et al., "High Quality Acoustic Rendering with Wave Field Synthesis", University of Erlangen-Nuremberg, Erlangen, Germany, Nov. 20-22, 2002, 8 pages.
Theile, "Spatial Perception in WFS Rendered Sound Fields", 2 pages, Mar. 22-25, 2004.
Theile et al., "Potential Wavefield Synthesis Applications in the Multichannel Stereophonic World", AES 24th International Conference on Multichannel Audio, pp. 1-15, Jun. 26-28, 2003.
Toole, "Direction and Space, the Final Frontiers: How Many Channels do We Need to be Able to Believe that We are 'There'?", Harman International Industries, Northridge, California, pp. 1-30, Mar. 5, 2000.
Toole, "Audio-Science in the Service of Art," Harman International Industries, Northridge, California, pp. 1-23, May 8, 1998.
Tsingos et al., "Validation of Acoustical Simulations in the 'Bell Labs Box'", Bell Laboratories-Lucent Technologies, 7 pages, Jun. 2002.
University of York Music Technology Research Group, "Surrounded by Sound—A Sonic Revolution", Retrieved Feb. 10, 2004, from http://www-users.york.ac.uk/~dtm3/RS/RSweb.htm, 7 pages.
Vaananen, "User Interaction and Authoring of 3D Sound Scenes in the Carrouso EU Project", Audio Engineering Society Convention Paper 5764, Presented at the 114th Convention, Mar. 22-25, 2003, pp. 1-9.
Vaananen et al., "Encoding and Rendering of Perceptual Sound Scenes in the Carrouso Project", AES 22nd International Conference of Virtual, Synthetic and Entertainment Audio, pp. 1-9, Jun. 15-17, 2002.
"Virtual and Synthetic Audio: The Wonderful World of Sound Objects", *Journal Audio Engineering Society*, vol. 51, No. 1/2, Jan./Feb. 2003, pp. 93-98.
Amatriain et al., "Transmitting Audio Content as Sound Objects", AES 22nd International Conference on Virtual, Synthetic and Entertainment Audio, Music Technology Group, IUA, UPF, Barcelona, Spain, pp. 1-11, Jun. 2002.
Amundsen, "The Propagator Matrix Related to the Kirchhoff-Helmholtz Integral in Inverse Wavefield Extrapolation", *Geophysics*, vol. 59, No. 11, Dec. 1994, pp. 1902-1909.
Avanzini et al., "Controlling Material Properties in Physical Models of Sounding Objects", ICMC'01-1 Revised Version, pp. 1-4, Sep. 18, 2001.
Chopard et al., "Wave Propagation in Urban Microcells: A Massively Parallel Approach Using the TLM Method", Retrieved Jul. 3, 2003, from http://cui.unige.ch/~luthi/links/tlm/tlm.html, 1 page.
Corey et al., "An Integrated Multidimensional Controller of Auditory Perspective in a Multichannel Soundfield", presented at the 111th Convention of the Audio Engineering Society, New York, New York, pp. 1-10, Nov. 2001.
Davis, "History of Spatial Coding", *Journal of the Audio Engineering Society*, vol. 51, No. 6, Jun. 2003, pp. 554-569.
De Poli et al., "Abstract Musical Timbre and Physical Modeling", Jun. 21, 2002, pp. 1-21.
De Vries et al., "Auralization of Sound Fields by Wave Field Synthesis", Laboratory of Acoustic Imaging and Sound Control, pp. 1-10, May 1999.
De Vries et al., "Wave Field Synthesis and Analysis Using Array Technology", Proc. 1999 IEEE Workshop on Applications of Signal Processing to Audio and Acoustics, New Paltz, New York, Oct. 17-20, 1999, pp. 15-18.
Farina et al., "Realisation of 'Virtual' Musical Instruments: Measurements of the Impulse Response of Violins Using MLS Technique", 9 pages, May 19-21, 1995.
Farina et al., "Subjective Comparison of 'Virtual' Violins Obtained by Convolution", 6 pages, May 19-21, 1995.
Holt, "Surround Sound: The Four Reasons", *The Absolute Sound*, Apr./May 2002, pp. 31-33.
Horbach et al., "Numerical Simulation of Wave Fields Created by Loudspeaker Arrays", Audio Engineering Society 107th Convention, New York, New York, Sep. 1999, pp. 1-16.
Kleiner et al., "Emerging Technology Trends in the Areas of the Technical Committees of the Audio Engineering Society", *Journal of the Audio Engineering Society*, vol. 51, No. 5, May 2003, pp. 442-451.
Landone et al., "Issues in Performance Prediction of Surround Systems in Sound Reinforcement Applications", Proceedings of the 2nd COST G-6 Workshop on Digital Audio Effects (DAFx99), NTNU, Trondheim, Dec. 9-11, 1999, 6 pages.
Boone, "Acoustic Rendering with Wave Field Synthesis", Presented at Acoustic Rendering for Virtual Enviroments, Snowbird, UT, May 26-29, 2001, pp. 1-9.
Budnik, "Discretizing the Wave Equation", In *What is and what will be: Integrating Spirituality and Science*, Retrieved Jul. 3, 2003, from http:..www.mtnmath.com/whatth/node47.html, 12 pages.

* cited by examiner

SOUND SYSTEM AND METHOD FOR CAPTURING AND REPRODUCING SOUNDS ORIGINATING FROM A PLURALITY OF SOUND SOURCES

RELATED APPLICATIONS

This application is a continuation of U.S. patent application Ser. No. 08/749,766, filed Nov. 20, 1996, entitled "Sound System and Method for Capturing and Reproducing Sounds Originating from a Plurality of Sound Sources", pending.

FIELD OF THE INVENTION

The present invention generally relates to acoustical reproduction and sound field reconstruction. More specifically, it relates to methods and apparatus for separately recording a plurality of sounds produced concurrently by a plurality of sound sources and/or simultaneously reproducing a plurality of sounds separately recorded or produced by a plurality of sound sources. The invention also relates to methods and apparatus for sound production including controlling the interaction between a plurality of sounds based on relationships therebetween.

BACKGROUND OF THE INVENTION

Systems for recording and reproducing sounds produced by a plurality of sound sources are generally known. In the musical context, for example, systems for recording and reproducing live performances of bands and orchestras are known. In those cases, the sound sources are the musical instruments and performers' voices. More generally, however, a sound source is any object that produces sound. In a basic sense, sound is a series of physical disturbances in a medium (e.g., air). Typically, sound is created when an object (a sound source) vibrates, sending out a series of waves that propagate through air (or other media). In air, sound waves comprise fluctuations in air pressure above and below the normal atmospheric pressure (e.g., 14.7 psi). These fluctuations are referred to as compressions and rarefactions. When compressions and rarefaction impinge upon our eardrums, we perceive sound. The greater the change in air pressure above and below normal atmospheric pressure, the greater the amplitude of the sound. Since most objects vibrate with a periodic back-and-forth motion or oscillation, most sound waves (and nearly all musical sounds) have a periodic repetition, replicating the object's motion. Thus, a sound wave can be characterized by frequency and amplitude and can be represented generally by a sine wave. However, real sounds and musical signals are actually complex waves made up of many sound waves of different frequencies superimposed on one another. One reason for this is that a vibrating object (and therefore a sound wave produced by that object) includes a fundamental frequency (its lowest frequency) and overtones or harmonics which are a multiple of the fundamental frequency. The presence of these harmonics contribute to a musical instrument's characteristics, such as its timbre or tonal color. Thus, two instruments (e.g., a piano and a violin) both played at the same fundamental frequency will sound different because they have different harmonic structures. For example, a violin produces stronger harmonics that extend higher in frequency than that of the piano.

Another factor that affects the perception of sound is phase. The term phase refers to the time relationship between two or more sound waves. A phase shift refers to a time displacement of a wave (e.g., a sine wave) relative to a fixed point. Phase shift has important consequences when sine waves are combined or superimposed. If two sine waves of equal frequency and the same phase are superimposed, their combination will create a wave of greater amplitude. If, however, one of the waves is phase-shifted by 180 degrees, then the two waves will cancel each other and produce no signal.

Recording and reproducing sound produced by a sound source typically involves detecting sound waves produced by the sound source, converting the sound waves to audio signals (digital or analog), storing the audio signals on a recording medium and subsequently reading and amplifying the stored audio signals and supplying them as an input to one or more loudspeakers to reconvert the audio signals back to sound. Audio signals are typically electrical signals that correspond to actual sound waves, however this correspondence is "representative", not "congruent", due to various limitations intrinsic to the process of capturing and converting acoustical data. Other forms of audio signals (e.g., optical), although more reliable in the transmission of acoustical data, encounter similar limitations due to capturing and converting the acoustical data from the original sound field.

The reproduction of sound by use of loudspeakers typically involves moving a loudspeaker cone back and forth to recreate a pattern of compressions and rarefactions. The movement of the cone is controlled by inputting audio signals to a driver that drives the loudspeaker. As a result, the quality of the sound produced by a loudspeaker partly depends on the quality of the audio signal input to the loudspeaker, and partly depends on the ability of the loudspeaker to respond to the signal accurately. Ideally, to enable precise reproduction of sound, the audio signals should correspond exactly to (i.e., be a perfect representation of) the original sound and the reconversion of the audio signals back to sound should be a perfect conversion of the audio signal to sound waves. In practice however, such perfection has not been achieved due to various phenomenon that occur in the various stages of the recording/reproducing process, as well as deficiencies that exist in the design concept of "universal" loudspeakers.

Additional problems are presented when trying to precisely record and reproduce sound produced by a plurality of sound sources. One significant problem encountered when trying to reproduce sounds from a plurality of sound sources is the inability of the system to recreate what is referred to as sound staging. Sound staging is the phenomena that enables a listener to perceive the apparent physical size and location of a musical presentation. The sound stage includes the physical properties of depth and width. These properties contribute to the ability to listen to an orchestra, for example, and be able to discern the relative position of different sound sources (e.g., instruments). However, many recording systems fail to precisely capture the sound staging effect when recording a plurality of sound sources. One reason for this is the methodology used by many systems. For example, such systems typically use one or more microphones to receive sound waves produced by a plurality of sound sources (e.g., drums, guitar, vocals, etc.) and convert the sound waves to electrical audio signals. When one microphone is used, the sound waves from each of the sound sources are typically mixed (i.e., superimposed on one another) to form a composite signal. When a plurality of microphones are used, the plurality of audio signals are typically mixed (i.e., superimposed on one another) to form a composite signal. In either case the composite signal is then stored on a storage medium. The composite signal can be subsequently read from the storage medium and reproduced in an attempt to recreate the original sounds produced by the sound sources. However, the mixing of signals, among other things, limits the ability to recreate the sound staging of the plurality of sound sources. Thus, when signals are mixed, the reproduced sound fails to precisely recreate the original sounds. This is one reason why an orchestra sounds different when listened to live as compared with a recording. This is one major drawback of prior sound systems. Other problems are caused by mixing as well.

While attempts have been made to address these drawbacks, none has adequately overcome the problem. For example, in some cases, the composite signal includes two separate channels (e.g., left and right) in an attempt to spatially separate the composite signal. In some cases, a third (e.g., center) or more channels (e.g., front and back) are used to achieve greater spatial separation of the original sounds produced by the plurality of sound sources. Two popular methodologies used to achieve a degree of spatial separation, especially in home theater audio systems, are Dolby Surround and Dolby Pro Logic. Dolby Pro Logic is the more sophisticated of the two and combines four audio channels into two for storage and then separates those two channels into four for playback over five loudspeakers. Specifically, a Dolby Pro Logic system starts with left, center and right channels across the front of the viewing area and a single surround channel at the rear. These four channels are stored as two channels, reconverted to four and played back over left, center and right front loudspeakers and a pair of monaural rear surround loudspeakers that are fed from a single audio channel. While this technique provides some measure of spatial separation, it fails to precisely recreate the sound staging and suffers from other problems, including those identified above.

Other techniques for creating spatial separation have been tried using a plurality of channels. However, regardless of the number of channels, such systems typically involve mixing audio signals to form one or more composite signals. Even systems touted as "discrete multi-channel", base the discreteness of each channel on a "directional component" (i.e., Dolby's AC-3, discrete 5.1 multichannel surround sound is based on five discrete directional channels and one omni-directional bass channel). "Directional components" help create a more engulfing acoustical effect, but do not address the critical losses of veracity within the audio signal itself.

Other separation techniques are commonly used in an attempt to enhance the recreation of sound. For example, each loudspeaker typically includes a plurality of loudspeaker components, with each component dedicated to a particular frequency band to achieve a frequency distribution of the reproduced sounds. Commonly, such loudspeaker components include woofer or bass (lower frequencies), mid-range (moderate frequencies) and tweeters (higher frequencies). Components directed to other specific frequency bands are also known and may be used. When frequency distributed components are used for each of multiple channels (e.g., left and right), the output signal can exhibit a degree of both spatial distribution and frequency distribution in an attempt to reproduce the sounds produced by the plurality of sound sources. However, maximum recreation of the original sounds is not fully achieved.

Another problem resulting from the mixing of either sounds produced by sound sources or the corresponding audio signals is that this mixing typically requires that these composite sounds or composite audio signals be played back over the same loudspeaker(s). It is well known that effects such as masking preclude the precise recreation of the original sounds. For example, masking can render one sound inaudible when accompanied by a louder sound. For example, the inability to hear a conversation in the presence of loud amplified music is an example of masking. Masking is particularly problematic when the masking sound has a similar frequency to the masked sound. Other types of masking include loudspeaker masking, which occurs when a loudspeaker cone is driven by a composite signal as opposed to an audio signal corresponding to a single sound source. Thus, in the later case, the loudspeaker cone directs all of its energy to reproducing one isolated sound, as opposed to, in the former, the loudspeaker cone must "time-share" its energy to reproduce a composite of sounds simultaneously.

Another problem with mixing sounds or audio signals and then amplifying the composite signal is intermodulation distortion. Intermodulation distortion refers to the fact that when a signal of two (or more) frequencies is input to an amplifier, the amplifier will output the two frequencies plus the sum and difference of these frequencies. Thus, if an amplifier input is a signal with a 400 Hz component and a 20 KHz component, the output will be 400 Hz and 20 KHz plus 19.6 KHz (20 KHz−400 Hz) and 20.4 KHz (20 KHz+400 Hz).

Another problem with existing loudspeakers is that they usually perform well at certain frequencies but not at others. Some are suited well for one type of music (e.g., rock), but not for others (e.g., a symphony). Furthermore, different frequency ranges require different levels of amplification to achieve an otherwise harmonious magnification. Current technology provides methods for suppressing such incongruencies, but the methods are artificial and present a very limited linear solution to a nonlinear problem. Also, their directional qualities are limited.

Thus, despite significant research and development, prior systems suffer various drawbacks and fail to maximize the ability of the system to precisely reproduce the original sounds.

OBJECTS OF THE INVENTION

It is an object of the present invention to overcome these and other drawbacks of the prior art.

It is another object of the present invention to provide an improved method and apparatus for recording and/or reproducing sounds produced by a plurality of sound sources.

It is another object of the present invention to provide a method and apparatus for separately recording a plurality of sounds produced concurrently by a plurality of sound sources.

It is another object of the present invention to provide a method and apparatus for simultaneously reproducing a plurality of separately recorded sounds or sounds produced by a plurality of sound sources.

It is another object of the present invention to provide an improved recording and playback system capable of producing and reproducing sounds to attempt to recreate actual sounds produced by sound sources, and controlling the reproduction to take into account power variations of the various signals.

It is another object of the present invention to provide an improved recording and playback system capable of capturing and reproducing sounds to recreate actual sounds produced by sound sources, where sounds from each of a plurality of sound sources (or a predetermined group of sources) are captured by separate sound detectors, and where the separately captured sounds are converted to audio signals, recorded, and played back by separately retrieving the stored audio signals from the recording medium and transmitting the retrieved audio signals separately to a separate loudspeaker system for reproduction of the originally captured sounds.

It is another object of the present invention to provide a method and apparatus for reproducing sounds produced by a plurality of sound sources, where sounds from each sound source (or a predetermined group of sources) are captured by separate sound detectors, and where the separately captured sounds are converted to audio signals, each of which is transmitted separately to a separate loudspeaker system for reproduction of the originally captured sounds.

It is another object of the present invention to provide a method and apparatus for reproducing a plurality of separately recorded sounds or sounds produced by a plurality of sound sources, where sounds from each source (or a predetermined group of sources) are captured by separate sound detectors, and where the separately captured sounds are converted to audio signals, each of which is transmitted separately to a separate loudspeaker system for reproduction of the originally captured sounds (with or without first recording the audio signals), where each loudspeaker system comprises a plurality of loudspeakers or a plurality of groups of loudspeakers (e.g., loudspeaker clusters) customized for reproduction of specific types of sound sources or group(s) of sound sources. Preferably the customization is based at least in part on characteristics of the sounds to be reproduced by the loudspeaker or based on the dynamic behavior of the sounds or groups of sounds.

It is another object of the present invention to provide a method and apparatus for reproducing a plurality of separately recorded sounds or sounds produced by a plurality of sound sources, where sounds from each sound source (or a predetermined group of sources) are captured by separate sound detectors, and where the separately captured sounds are converted to audio signals, each of which is transmitted separately to a separate loudspeaker system for reproduction of the originally captured sounds (with or without first recording the audio signals), where each signal path is connected to a separate amplification systems to separately amplify audio signals corresponding to the sounds from each source (or predetermined group of sources). The amplifier systems may be customized for the particular characteristics of the audio signals that it will be amplifying.

It is another object of the present invention to provide a method and apparatus for reproducing a plurality of separately recorded sounds or sounds produced by a plurality of sound sources, where sounds from each sound source (or a predetermined group of sound sources) are captured by separate sound detectors, and where the separately captured sounds are converted to audio signals, each of which is transmitted to a separate loudspeaker system for reproduction of the originally captured sounds (with or without first recording the audio signals), where each signal path is connected to an amplification system to separately amplify audio signals corresponding to the sounds from each source (or predetermined group of sources) and where the amplifier systems are separately controlled by a controller so that the relationship among the components of the power (amplifier) network and those of the loudspeaker network can be selectively controlled. This control can be automatically implemented based on the dynamic characteristics of the audio signals (or the produced sounds) or a user can manually control the reproduction of each sound (or predetermined groups of sounds) through a user interface that enables the user to independently adjust the input power levels of each sound (or predetermined group of sounds) from "off" to relatively high levels of corresponding output power levels without necessarily affecting the power level of any of the other independently controlled audio signals.

SUMMARY OF THE INVENTION

To accomplish these and other objects of the present invention, improved methods and apparatus for recording and/or reproducing sound are disclosed. According to one embodiment, a method and apparatus for recording and reproducing sound comprises a plurality of sound sources or predetermined groups of sound sources for concurrently producing sounds, a plurality of detectors for detecting sound waves from respective ones of the sound sources or from respective ones of the groups of sound sources and converting each of the detected sound waves to separate audio signals without mixing the audio signals and separately transmitting each of the audio signals to one of a plurality of loudspeaker systems for reproduction.

If desired, the audio signals output from the sound detectors may be recorded on a recording medium for subsequent readout prior to being transmitted to the loudspeaker systems for reproduction. If recorded, preferably the recording mechanism separately records each of the audio signals on the recording medium without mixing the audio signals. Subsequently, the stored audio signals are separately retrieved and are provided over separate signal paths to individual amplifier systems and then to the separate loudspeaker systems. Preferably, the audio signals are separately controllable, either automatically or manually. The amplifier and loudspeaker systems for each signal path may be automatically controlled by a dynamic controller that controls the relationship among the amplifier systems, the components of the amplifier systems, the loudspeaker systems and the components of the of the loudspeaker systems. For example; the controller can individually turn on/off individual amplifiers of an amplifier system so that increased/decreased power levels can be achieved by using more or less amplifiers for each audio signal instead of stretching the range of a single amplifier. Similarly, the controller can control individual loudspeakers within a loudspeaker system.

The loudspeaker systems preferably are each made up of one or more loudspeakers or loudspeaker clusters and are customized for reproduction of specific types of sounds produced by the respective sound source or group of sound sources associated with the signal path. For example, a loudspeaker system may be customized for the reproduction of violins or stringed instruments. The customization may take into account various characteristics of the sounds to be reproduced, including, frequency, directivity, etc. Additionally, the loudspeakers for each signal path may be configured in a loudspeaker cluster that uses an explosion technique, i.e., sound radiating from a source outwards in various directions (as naturally produced sound does) rather than using an implosion technique, i.e.; sound projecting inwardly toward a listener (e.g., from a perimeter of speakers as with surround sound or from a left/right direction as with stereo). In other circumstance, an implosion technique or a combination of explosion/implosion may be preferred.

DETAILED DESCRIPTION OF THE PREFERRED EMBODIMENTS

Figure 1A:
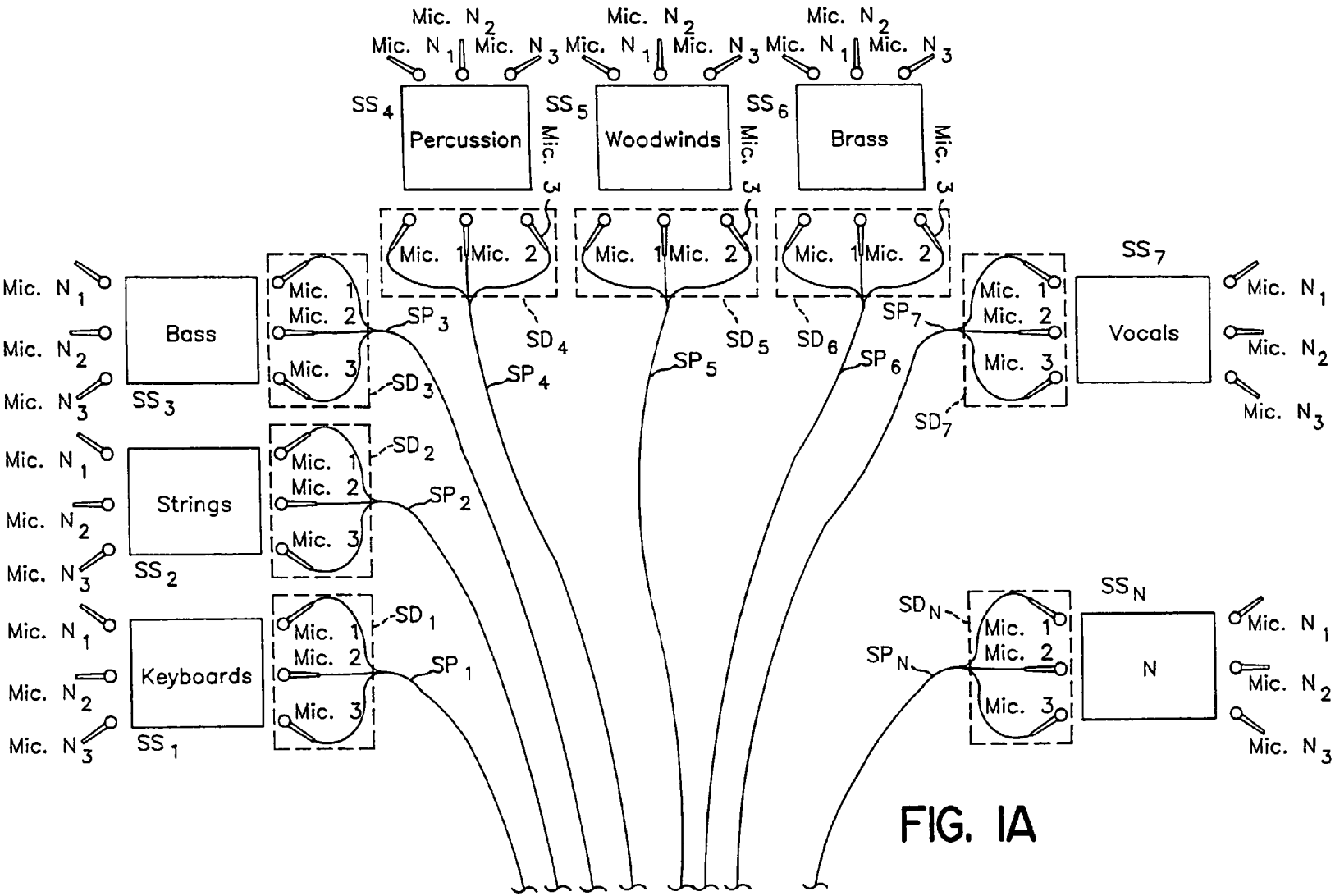
FIG. 1 is a schematic illustration of a sound capture and recording system according to one embodiment of the present invention.
Figure 1B:
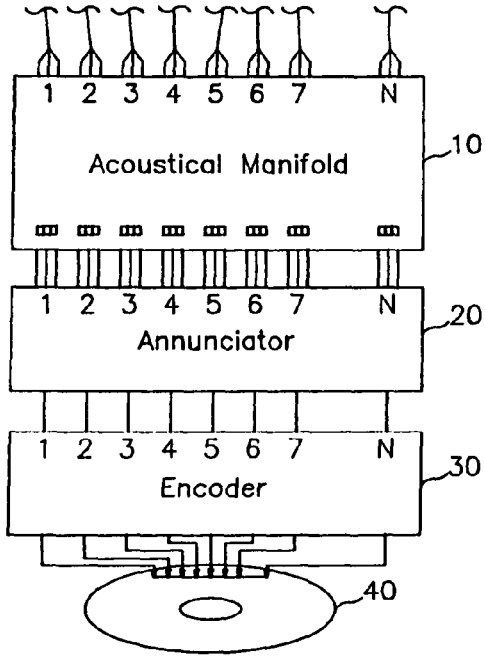
Figure 2A:
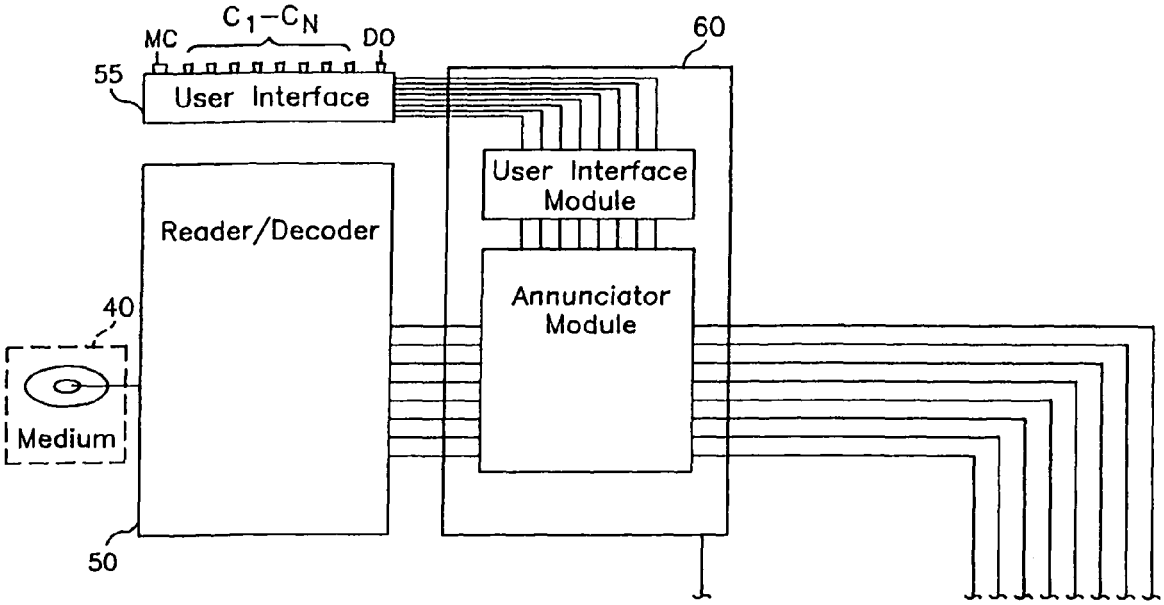
FIG. 2 is a schematic illustration of a sound reproduction system according to one embodiment of the present invention.
Figure 2B:
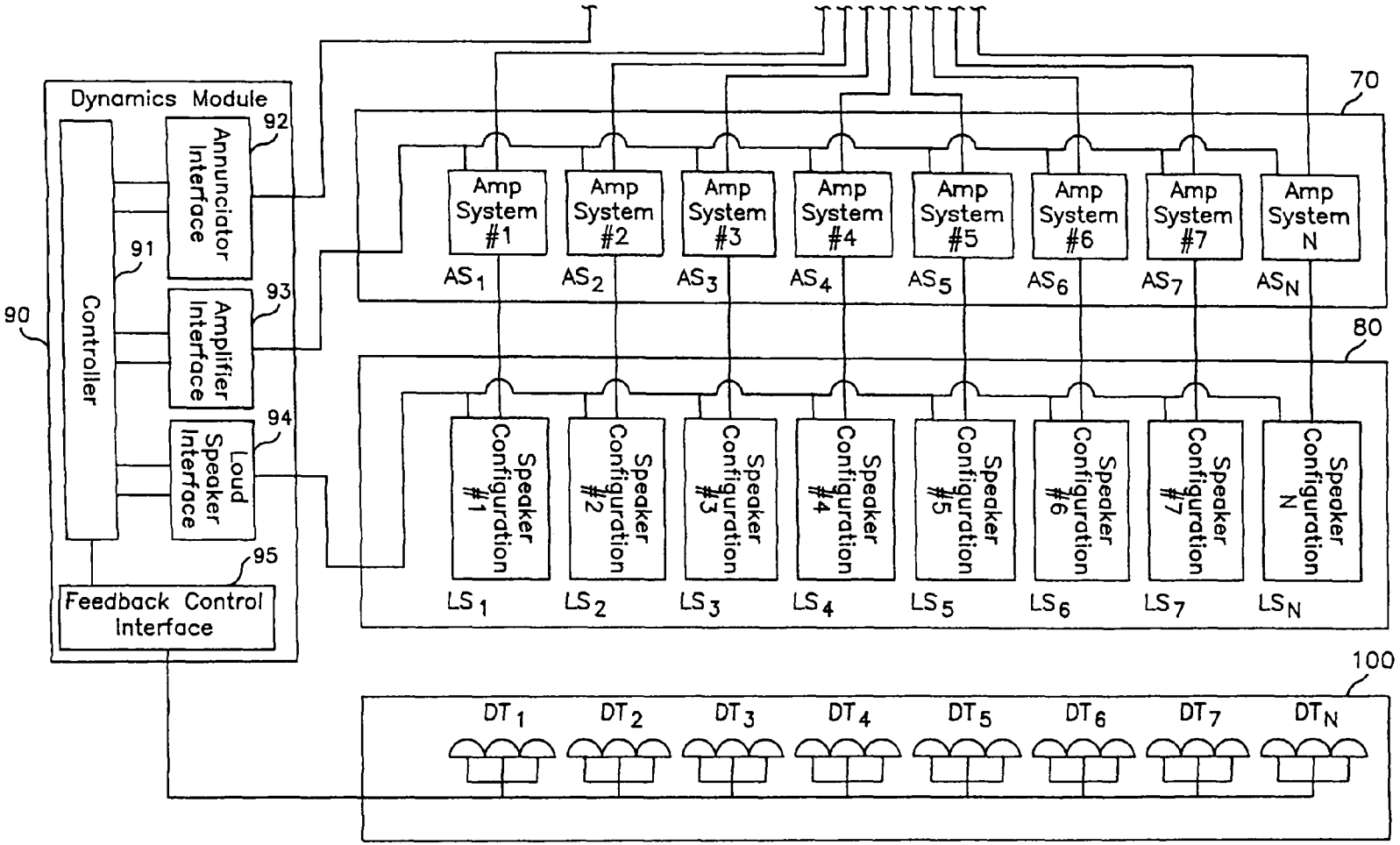

FIG. 1 is a schematic illustration of a sound capture and recording system according to one embodiment of the present invention. As shown in FIG. 1, the system comprises a plurality of sound sources ($SS_1$-$SS_N$) for producing a plurality of sounds, a plurality of sound detectors ($SD_1$-$SD_N$), such as microphones, for capturing or detecting the sounds produced by the N sound sources and for separately converting the N sounds to N separate audio signals. As shown in FIG. 1, the N separate audio signals may be conveyed over separate signal paths ($SP_1$-$SP_N$) to be recorded on a recording medium 40. Alternatively, the N separate audio signals may be transmitted to a sound reproduction system (such as shown in FIG. 2), which preferably includes N loudspeaker systems for converting the audio signals to sound. If the audio signals are to be recorded, the recording medium 40 may be, e.g., an optical disk on which digital signals are recorded. Other storage media (e.g., tapes) and formats (e.g., analog) may be used. In the event that digital recording is used, the N audio signals are separately provided over N signal paths to an encoder 30. Any suitable encoder can be used. The outputs of the encoder 30 are applied to the recording medium 40, where the signals are separately recorded on the recording medium 40. Multiplexing techniques (e.g., time division multiplexing) may also be used. If no recording is performed, the output of the acoustical manifold 10 or the sound detectors ($SD_1$-$SD_N$) may be supplied directly to the amplifier network 70 or acoustical manifold 60 (FIG. 2).

If desired, the N audio signals output from the N sound detectors ($SD_1$-$SD_N$) may be input to an acoustical manifold 10 and/or an annunciator 20 prior to being input to encoder 30. The acoustical manifold 10 is an input/output device that receives audio signal inputs, indexes them (e.g., by assigning an identifier to each data stream) and determines which of the inputs to the manifold have a data stream (e.g., audio signals) present. The manifold then serves as a switching mechanism for distributing the data streams to a particular signal path as desired (detailed below). The annunciator 20 can be used to enable flexibility in handling different numbers of audio signals and signal paths. Annunciators are active interface modules for transferring or combining the discrete data streams (e.g., audio signals) conveyed over the plurality of signal paths at various points within the system from sound capture to sound reproduction. For example, when the number of signal paths output from the sound detectors is equal to the number of amplifier systems and/or loudspeaker systems, the function of the annunciator can be passive (no combining of signals is necessarily performed). When the number of outputs from the sound detectors is greater than the number of amplifier systems and/or loudspeaker systems, the annunciator can combine selected signal paths based on predetermined criteria, either automatically or under manual control by a user. For example, if there are N sound sources and N sound detectors, but only N-1 inputs to the encoder are desired, a user may elect to combine two signal paths in a manner described below. The operation and advantages of these components are further detailed below.

FIG. 2 schematically depicts a sound reproduction system according to a preferred embodiment of the invention. It can be used with the sound capture/recording system of FIG. 1 or with other systems. This portion of the system may be used to read and reproduce stored audio signals or may be used to receive audio signals that are not stored (e.g., a live feed from the sound detectors $SD_1$-$SD_N$). When it is desired to reproduce sounds based on the stored audio signals, the stored audio signals are read by a reader/decoder 50. The reader portion may include any suitable device (e.g., an optical reader) for retrieving the stored audio signals from the storage medium 40 and, if necessary or desired, any suitable decoder may be used. Preferably, such a decoder will be compatible with the encoder 30. The separate audio signals from the reader/decoder 50 are supplied over signal paths to an amplifier network 70 and then to a loudspeaker network 80 as detailed below. Prior to being supplied to the amplifier network 70, the audio signals from reader/decoder 50 may be supplied to annunciator 60.

For simplicity, it will be assumed that N audio signals are input to annunciator 60 and that N audio signals are output therefrom. It is to be understood, however, that different numbers of signals can be input to and output from annunciator 20. If, for example, only five audio signals are output from annunciator 60, only five amplifier systems and five loudspeaker systems are necessary. Additionally, the number of audio signals output from annunciator 60 may be dictated by the number of amplifier or loudspeaker systems available. For example, if a system only has four amplifier systems and four loudspeaker systems, it may be desirable for the annunciator to output only four audio signals. For example, the user may elect to build a system modularly (i.e., adding amplifier systems and loudspeaker systems one or more at a time to build up to N such systems). In this event, the annunciator facilitates this modularity. The user interface 55 enables the user to select which audio signals should be combined, if they are to be combined, and to control other aspects of the systems as detailed below.

Figure 3:
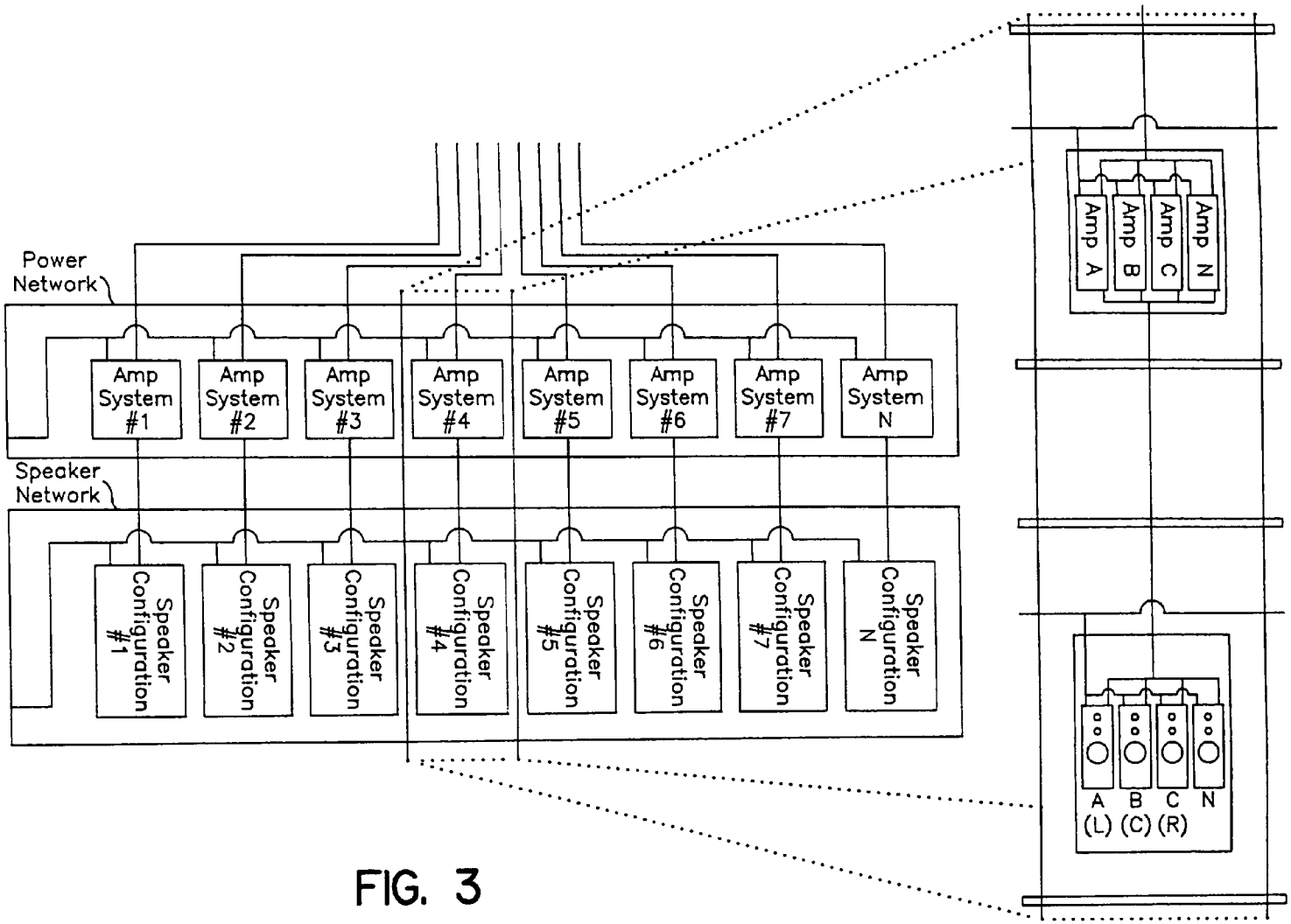
FIG. 3 is a schematic illustration of an exploded view of an amplifier system and loudspeaker system for one signal path according to one embodiment of the present invention.

Referring to FIGS. 2 and 3, the amplifier network 70 preferably comprises a plurality of amplifier systems $AS_1$-$AS_N$ each of which separately amplifies the audio signals on one of the N signal paths. As shown in FIG. 3, each amplifier system may comprise one or more amplifiers (A-N) for separately amplifying the audio signals on one of the N signal paths. From the amplifier network 70, each of the audio signals are supplied over separate signal paths to a loudspeaker network 80. The loudspeaker network 80 comprises N loudspeaker systems $LS_1$-$LS_N$ each of which separately reproduces the audio signals on one of the N signal paths. As shown in FIG. 3, each loudspeaker system preferably includes one or more loudspeakers or loudspeaker clusters (A-N) for separately reproducing the audio signals on each of the N signal paths.

Preferably, each loudspeaker or loudspeaker cluster is customized for the specific types of sounds produced by the sound source or groups of sound sources associated with its signal path. Preferably, each of the amplifier systems and loudspeaker systems are separately controllable so that the audio signals sent over each signal path can be controlled individually by the user or automatically by the system as detailed below. More preferably, each of the individual amplifiers (A-N) and each of the individual loudspeakers (A-N) are each separately controllable. For example, it is preferable that each of amplifiers A-N for amplifier system $AS_1$ is separately controllable to be on or off, and if on to have variable levels of amplification from low to high. In this way, power levels of audio signals on that signal path may be stepped up or down by turning on specific amplifiers within an amplifier system and varying the amplification level of one or more of the amplifiers that are on. Preferably, each of the amplifiers of an amplifier system is customized to amplify the audio signals to be transmitted through that amplifier system. For example, if the amplifier system is connected in a signal path that is to receive audio signals corresponding to sounds that consist of primarily low frequencies (e.g., bass sounds from a drum), each of the amplifiers of that amplifier system may be designed to optimally amplify low frequency audio signals. This is an advantage over using amplifiers that are generic to a broad range of frequencies. Moreover, by providing multiple amplifiers within one amplifier system for a specific type of audio signal (e.g., sounds that consist of primarily low frequencies), the power level output from the amplifier system can be stepped up or down by turning on or off individual amplifiers. This is an advantage over using a single amplifier that must be varied from very low power levels to very high power levels. Similar advantages are achieved by using multiple loudspeakers within each loudspeaker system. For example, two or more loudspeakers operating at or near a middle portion of a power range will reproduce sounds with less distortion than a single loudspeaker at an upper portion of its power range. Additionally, loudspeaker arrays may be used to effect directivity control over 360 degrees or variations thereof.

As also shown in FIG. 2, the present invention may include a user interface 55 to provide a user with the ability to manually manipulate the audio signals on each signal path independently of the audio signals on each of the other signal paths. This ability to manipulate includes, but is not limited to, the ability to manipulate: 1) master volume control (e.g., to control the volume or power on all signal paths); 2) independent volume control (e.g., to independently control the volume or power on one or more individual signal paths); 3) independent on/off power control (e.g., to turn on/off individual signal paths); 4) independent frequency control (e.g., to independently control the frequency or tone of individual signal paths); 5) independent directional and/or sector control (e.g., to independently control sectors within individual signal paths and/or control over the annunciator.

Preferably, the user interface 55 includes a master volume control (MC) and N separate controls ($C_1$-$C_N$) for the N signal paths. A dynamics override control (DO) may also be provided to enable a user to manually override the automatic dynamic control of dynamic controller 90.

Also shown in FIG. 2 is a dynamic control module 90, which can provide separate control of the amplifier systems ($AS_1$-$AS_N$), the loudspeaker systems ($LS_1$-$LS_N$) and the annunciators 20, 60. Dynamics control module 90 is preferably connected to the user interface 55 (e.g., directly or via annunciator 60) to permit user interaction and manual control of these components.

According to one aspect of the invention, dynamics control module 90 includes a controller 91, one or more annunciator interfaces 92, one or more amplifier system interfaces 93, one or more loudspeaker interfaces 94 and a feedback control interface 95. The annunciator interface 92 is connected to one or more annunciators (20, 60). The amplifier interface 93 is operatively connected to the amplifier network 70. The loudspeaker interface 94 is connected to the loudspeaker network 80. Dynamics control module 90 controls the relationship among the amplifier systems and loudspeaker systems and the individual components therein. Dynamics control module 90 may receive feedback via the feedback control interface 95 from the amplification network 70 and/or the loudspeaker network 80. Dynamics control module 90 processes signals from amplification network 70 and/or sounds from loudspeaker network 80 to control amplification network 70 and loudspeaker network 80 and the components thereof. Dynamics control module 90 preferably controls the power relationship among the amplifier systems of the amplification network 70. For example, as power or volume of an amplifier system is increased, the dynamic response of a particular audio signal amplified by that amplifier system may vary according to characteristics of that audio signal. Moreover, as the overall power of the amplifier network is increased or decreased, the dynamic relationship among the audio signals in the separate signal paths may change. Dynamics control module 90 can be used to discretely adjust the power levels of each amplifier system based on predetermined criteria. An example of the criteria on which dynamics control module 90 may base its adjustment is the individual sound signal power curves (e.g., optimum amplification of audio signals when ramping power up or down according to the power curves of the original sound event). Module 90 can discretely activate, deactivate, or change the power level of, any of the amplification systems 70 $AS_1$-$AS_N$ and preferably, the individual components (A-N) of any given amplifier system $AS_1$-$AS_N$.

Module 90 can also control the loudspeaker network 80 based on predetermined criteria. Preferably, module 90 can discretely activate, deactivate, or adjust the performance level of each individual loudspeaker system and/or the individual loudspeakers or loudspeaker clusters (A-N) within a loudspeaker system ($LS_1$-$LS_N$). Thus, the system components are capable of being individually manipulated to optimize or customize the amplification and reproduction of the audio signals in response to dynamic or changing external criteria (e.g., power), sound source characteristics (e.g., frequency bandwidth for a given source), and internal characteristics (e.g., the relationship between the audio signals of the different signal paths).

The user interface 55 and/or dynamic controller 90 enables any signal path or component to be turned on/off or to have its power level controlled either automatically or manually. The dynamic controller 90 also enables individual amplifiers or loudspeakers within an amplifier system or loudspeaker system to be selectively turned on depending, for example, on the dynamics of the signals. For example, it is advantageous to be able to turn on two amplifiers within one system to increase the power level of a signal rather than maxing out the amplification of a single amplifier which can cause undesired distortion.

As will be apparent from the foregoing description, whether the N separate audio signals are recorded first and then reproduced or reproduced without first being recorded, the present invention enables various types of control to be effected to enable the reproduced sounds to have desired characteristics. According to one embodiment, the N separate audio signals output from the sound detectors ($SD_1$-$SD_N$) are maintained as N separate audio signals throughout the system and are provided as N separate inputs to the N loudspeaker systems. Typically, it is desired to do this to accurately reproduce the originally captured sounds and avoid problems associated with mixing of audio signals and/or sounds. However, as detailed herein various types of selective control over the audio signals can be effected by using acoustical manifold 10, one or more annunciators (20, 60), a user interface 55 and a dynamic controller 90 to enable various types of desired mixing of audio signals to permit modular expansion of a system. For example, one or more acoustical manifolds 10 can be used at various points in the system to enable audio signals on one signal path to be switched to another signal path. For example, if the sounds produced by SS1 are captured by SDI and converted to audio signals on signal path SP1, it may be desired to ultimately provide these audio signals to loudspeaker system $LS_4$ (e.g., since the loudspeakers may be customized for a particular type of sound source). If so, then the audio signals input to the acoustical manifold 10 on SP1 are routed to output 4 of the acoustical manifold 10. Other signals may be similarly switched to other signal paths at various points within the system. Thus, if the characteristics of the sounds produced by a sound source (SS) as captured by a sound detector (SD) change, the acoustical manifold 10 enables those signals to be routed to an amplifier system and/or loudspeaker system that is customized for those characteristics, without reconfiguring the entire system.

One or more annunciators (e.g., 20, 60) may be used to selectively combine two or more audio signals from separate signal paths or it can permit the N separate audio signals to pass through all or portions of the system without any mixing of the audio signals. One advantage of this is where there are more sound detectors then there are amplifier systems or loudspeaker systems. Another is when there are less amplifier systems and/or loudspeaker systems than there are signal paths. In either case (or in other cases) it may be desired to selectively combine audio signals corresponding to the sounds produced by two or more sound sources. Preferably, if such sounds or audio signals are mixed, selective mixing is performed so that signals having common characteristics (e.g., frequency, directivity, etc.) are mixed. This also enables modular expansion of the system.

As will be apparent from the foregoing, during the entire process from the detection of the sound to its reproduction by the loudspeakers, each of the audio signals corresponding to sounds produced by a sound source are preferably maintained separate from other sounds/audio signals produced by another sound source. Unless specifically desired to do so, the signals are not mixed. In this way, many of the problems with prior systems are avoided. While the foregoing discussion addresses the use of separate signal paths to keep the audio signals separate, it is to be understood that this may also be accomplished by multiplexing one or more signals over a signal path while maintaining the information separate (e.g., using time division multiplexing).

If desired, a feedback system 100 (FIG. 2) may be provided. If used, it can serve at least two primary functions. The first relates to acoustical data acquisition and active feedback transmission. This is accomplished, for example, by use of diagnostic transducers $DT_1$-$DT_N$ that measure the output data (e.g., sounds) exiting each port of the system (e.g., each loudspeaker system), providing feedback to the dynamics control module 90 via the feedback control interface 95. The dynamics control module 90 then controls the system components according to a predetermined control scheme. A second function relates to the dynamic control schemes. The dynamics control module 90 controls the macro/micro relationships between playback system components, systems, and subsystems under dynamic conditions. The dynamics module 90 controls the micro relationships among the components (e.g., amplifiers and/or loudspeakers within a single signal path) and the macro relationships among the separate signal paths. The micro relationships include the relationship between individual amplifiers within a given amplifier system (e.g., where each signal path has its own discrete amplifier system with one or more amplifiers) and/or the micro relationships between individual loudspeakers within a given loudspeaker system (e.g., where each signal path has its own discrete loudspeaker system with one or more loudspeakers). The macro relationships include the relationships among the amplifier systems and loudspeaker systems of the separate signal paths. Such control is implemented according to predetermined criteria or control schemes (e.g., based on the characteristics the original sound, the acoustics of the venue, the desired directivity patterns, etc.). Such control schemes can be embedded in the audio signals of each signal path, permanently hard-coded into the amplifier system for each signal path, or determined by active feedback signals originating from feedback system 100 based on the actual sounds produced. The dynamics control module 90 can control the macro relationships between the discrete presentation channels as the dynamics of the systems change (e.g., changes in master volume control, changes in the playback system configuration, changes in the venue dynamics, changes in recording methods/accuracies, changes in music type, etc.). Diagnostic channels can include a number of active and passive feedback paths linking the output data from each signal path to a control module which, in turn, communicates a predetermined control scheme to each signal path and/or specific discrete signal paths. A purpose of the diagnostic system is to provide a method for controlling the interaction between individual sounds within a given sound field as the dynamics of each sound change in proportion to changes in volume levels and/or changes in the dynamics of the performance venue.

Figure 4:
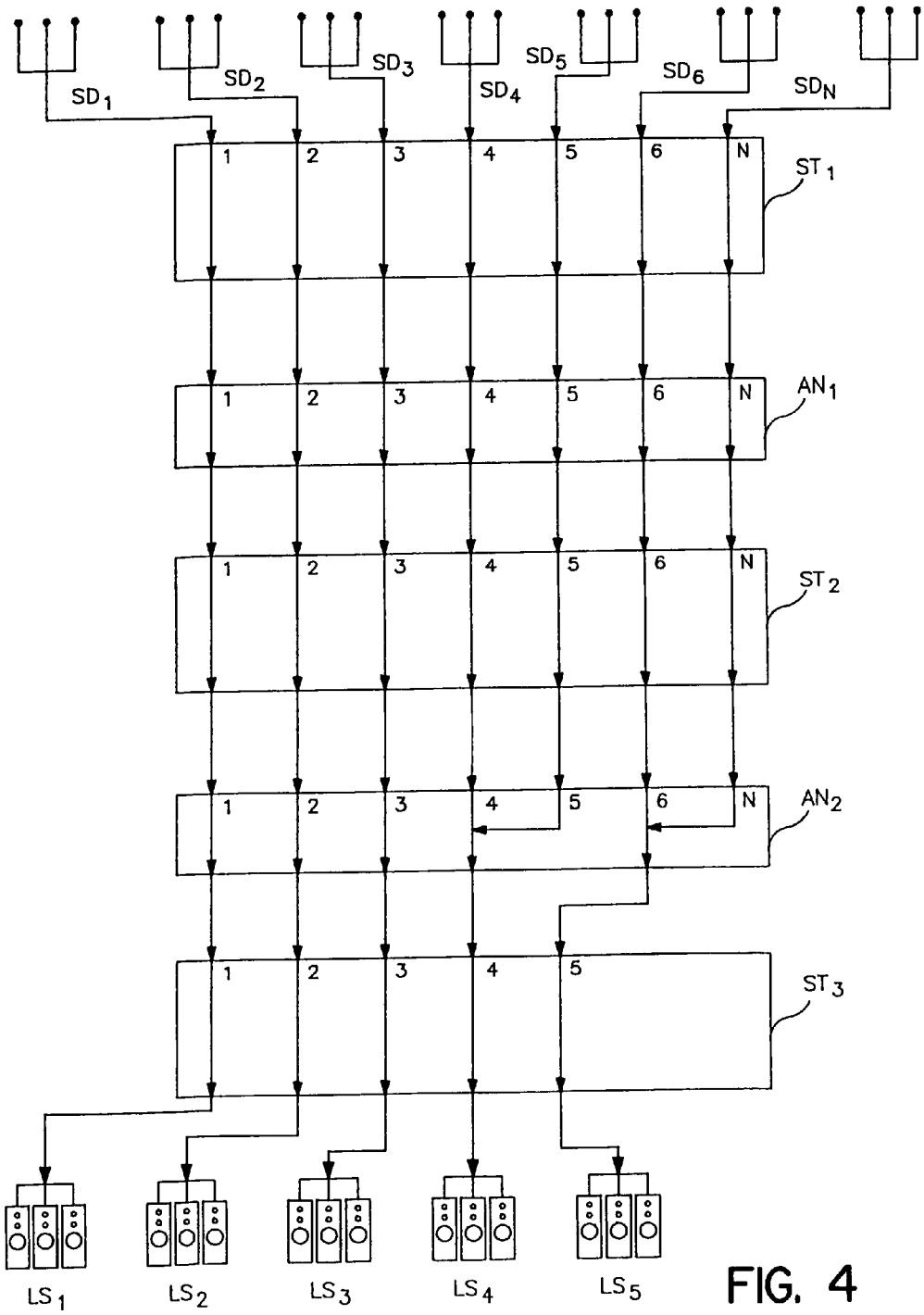
FIG. 4 is a schematic illustration of an example configuration for an annunciator according to one embodiment of the present invention.
Figure 5:
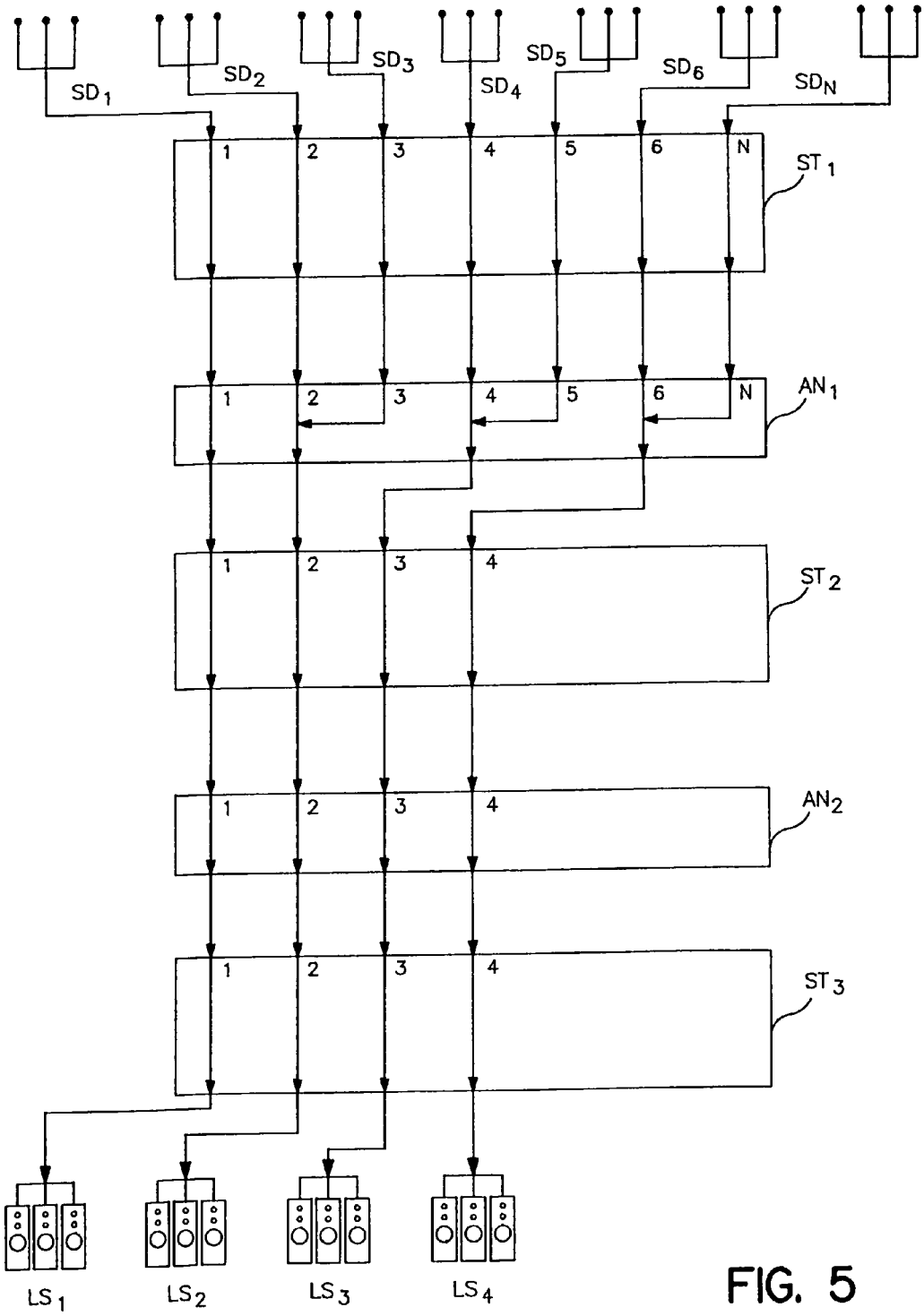
FIG. 5 is a schematic illustration of an example configuration for an annunciator according to one embodiment of the present invention.
Figure 6:
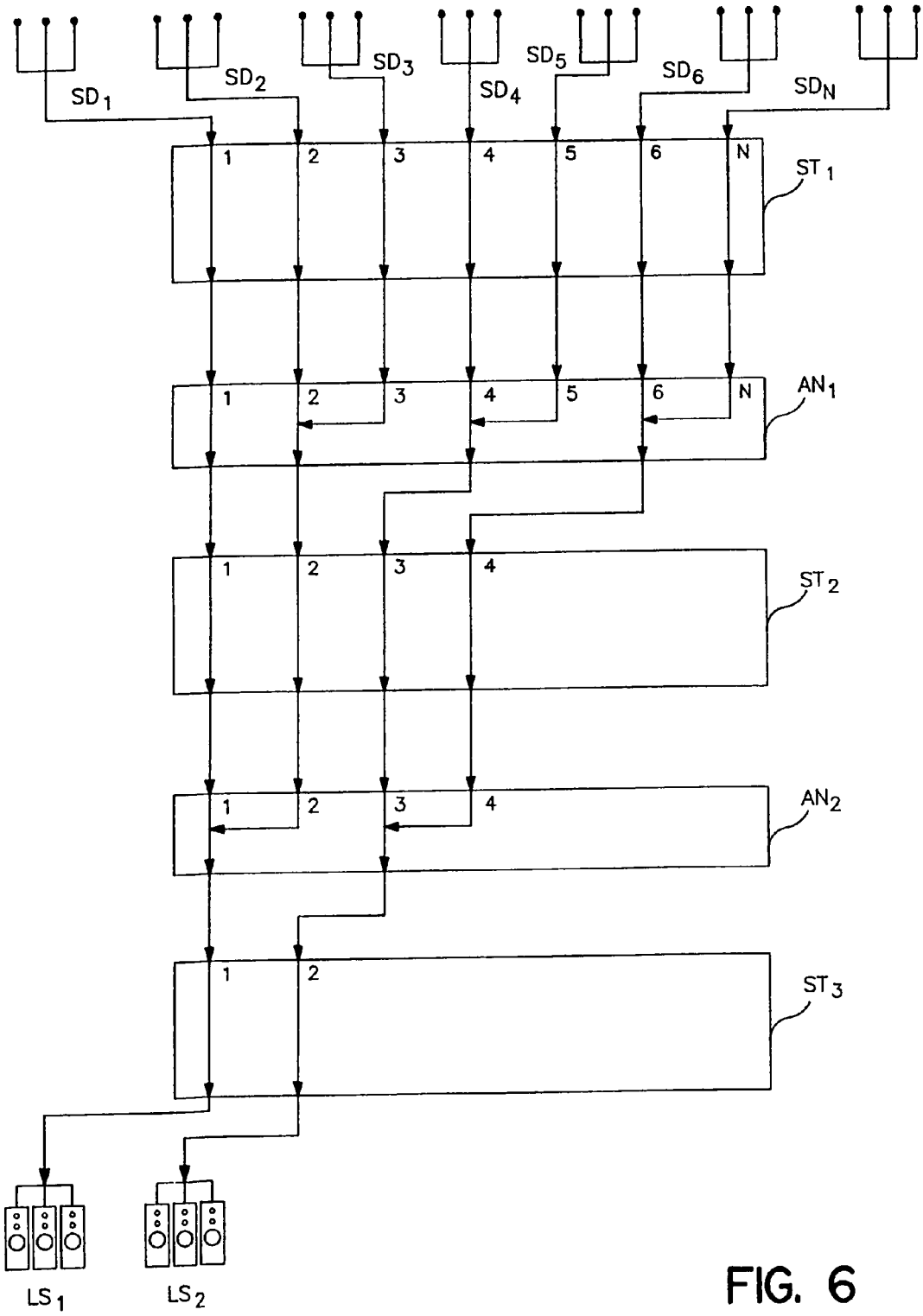
FIG. 6 is a schematic illustration of an example configuration for an annunciator according to one embodiment of the present invention.

By way of example, FIGS. 4, 5 and 6 depict various configurations for a system having multiple stages ($ST_1$-$ST_3$) and multiple annunciators ($AN_1$-$AN_2$). FIG. 4 depicts N signals input but only five outputs. FIG. 5 depicts N inputs with four outputs. FIG. 6 depicts N inputs and only two outputs. In each of FIGS. 4-6, the various stages can be Capture, Transmission (e.g., recording or live feed) and Presentation stages. Other stages can be used. For example, the Capture stage may include a first number of signal paths to capture the sounds produced by the sound sources. Preferably, there is one signal path for each sound source, but more or less may be used. The Transmission stage may include a second number of signal paths between the Capture stage and the recording medium and/or other portions (e.g., playback) of the system or transmitted to a "live feed" network. The second number of signal paths may be greater than, less than or equal to the first number of signal paths. The Presentation stage may include a third number of signal paths for reproduction of the sounds so that separate amplifier and loudspeaker systems may be used for each signal path. The third number of signal paths may be greater than, less than or equal to the first and or second number of signal paths. Preferably, the first, second and third number of signal paths are equal to enable independence throughout the Capture, Transmission and Presentation stages. When the number of signal paths are not equal, however, the annunciator module serves to control the signal paths and routing of signals thereover.

For purposes of example only, the sound sources $SS_1$-$SS_N$ may include keyboards (e.g., a piano), strings (e.g., a guitar), bass (e.g., a cello), percussion (e.g., a drum), woodwinds (e.g., a clarinet), brass (e.g., a saxophone), and vocals (e.g., a human voice). These seven identified sound sources represent the seven major groups of musical sound sources. The invention does not require seven sound sources. More or less can be used. Of course, other sound sources or groups of sound sources may be also be used as indicated by box $SS_N$. In the general case, N sound sources may be used where N is an integer greater than 1, or equal, but preferably greater than 1. It is well known that each of these seven major groups of musical sound sources have different audio characteristics and that, while each individual sound source within a group may have significant tonal differences (i.e., the violin and guitar), the sound sources within a group may have one or more common characteristics.

According to one aspect of the present invention, the sounds produced by each of the N sound sources $SS_1$-$SS_N$ are separately detected by one of a plurality of sound detectors $SD_1$-$SD_N$, for example, N microphones or microphone sets. Preferably, the sound detectors are directional to detect sound from substantially only one or selected ones of the plurality of sound sources. Each of the N sound detectors preferably detect sounds produced by one of the N sound sources and converts the detected sounds to audio signals. If each of the N sound sources simultaneously produces sound, then N separate audio signals will exist. Each sound detector may comprise one or more sound detection devices. For example, each sound detector may comprise more than one microphone. According to a preferred embodiment, three microphones (left, right and center) are used for each sound source. As detailed below, the use of these microphones is just one example of the use of a plurality of sound detection devices for each sound source. In other situations, more or less may be desired. For example, it may be desirable to surround a source with a plurality of microphones to obtain more directional information. The audio signals output from each of the N sound detectors or sound detection devices are supplied over a separate signal path as described above.

Each signal path may comprise multiple channels. For example, as shown in FIG. 1, each signal path may include a plurality of channels, (e.g., a left, right and center channel). In the general case, each signal path comprises M channels, where M is an integer greater than or equal to 1. However, it is not necessary for each signal path to have the same number of channels. For simplicity of discussion, it will be assumed that there are M channels for each of the N signal paths.

The number of channels for a particular signal path need not be limited to three. More or fewer channels may be incorporated as desired. For example, a plurality of channels may be used to provide directional control (e.g., left, right and center). However, some or all of the channels may be used to provide frequency separation or for other purposes. For example, if three channels are used, each of the three channels could represent one musical instrument within a given group. For example, the musical group may be "strings" (e.g., if the event being recorded has two violins and one acoustical guitar). In this case, one channel could be used for one violin, another channel could be used for the second violin, and the third channel could be used for the acoustical guitar. Another use of separate channels is to enable power stepping, where one channel is used for audio signals up to a first level, then a second channel is added as the power level is increased above the first level, and so on. This method helps regulate the optimum efficiency level for each of the loudspeakers used in the loudspeaker network.

The recording process, if used, generally involves separately recording the M×N audio signals onto the recording medium 40 to enable the M×N signals to be subsequently read out and reproduced separately. The recording and read out may be accomplished in a standard manner by providing independent recording/reading heads for each signal path/channel or by time-division multiplexing the audio signals through one or more recording/reading heads onto or from M×N tracks of the recording medium.

According to another aspect of the invention, the separately recorded audio signals are separately reproduced. As shown in FIG. 2, the reproduction of the audio signals includes separately retrieving the M×N signals by playback mechanism 50 (and performing any necessary or desired decoding). Then the audio signals are supplied over N separate signal paths (where each signal path may have M channels) to an amplifier network 70 having N amplifier systems and providing the output of the N amplifier systems to loudspeaker network 80, which preferably comprises N loudspeaker systems. Each loudspeaker system may comprise M×N loudspeakers or a greater or lesser number of loudspeakers, as detailed below.

According to one embodiment of the present invention, each sound source may be a group of sound sources instead of an individual source. Preferably, each group includes sound sources with one or more similar characteristics. For example, these characteristics may include musical groupings (keyboards, strings, bass, percussion, woodwinds, brass group, and vocals), frequency bandwidth, or other characteristics. Thus, if more than one type of string instruments is used, it may be acceptable to use one signal path for the string instruments and separate signal paths, etc. for other sound sources or groups of sound sources. This still enables recognition of the advantages derived from the use of customized loudspeaker systems since sounds with common characteristics are produced by the same loudspeaker system.

According to one embodiment, the criteria used for grouping sound sources is related to a common dynamic behavior of particular audio signals when they are amplified. For example, a particular amplifier may have different distortion effects on different audio signals having different characteristics (e.g., frequency bandwidth). Thus, it also may be preferable to use a different type of amplifier system for different types of audio signals. Another criteria used for grouping sound sources is common directivity patterns. For instance, "horns" are very directional and can be grouped together while "keyboard instruments" are less directional than horns and would not be compatible with the "horns" customized speaker configuration, and therefore would not be grouped together with horns.

The sound system need not be limited to any particular number of signal paths. The number of signal paths can be increased or decreased to accommodate larger or smaller numbers of individual sound sources or sound groups. Further, application of the system is not limited to musical instruments and vocals. The sound system has many applications including standard movie theater sound systems, special movie theaters (e.g., OmniMax, IMAX, Expos) cyberspace/computer music, home entertainment, automobile and boat sound systems, modular concert systems (e.g., live concerts, virtual concerts), auto system electronic crossover interface, home system electronic crossover interface, church systems, audio/visual systems (e.g., advertising billboards, trade shows), educational applications, musical compositions, and HDTV applications, to name but a few.

Preferably, loudspeaker network 80 consists of several loudspeaker systems, each including a plurality of loudspeakers or loudspeaker clusters each of which is used for one of the signal paths. Each loudspeaker cluster includes one or more loudspeakers customized for the type of sounds that it is used to reproduce. A given loudspeaker cluster may be responsive to the power change of the corresponding amplification system. For example, if the power level supplied to a given loudspeaker network is below a first predetermined level, one or a group of loudspeaker components may be active to reproduce sound. If the power level exceeds the first predetermined level, a second or second group of loudspeaker components may become active to reproduce the sound. This avoids overloading the first loudspeaker (or first group of loudspeakers) and also avoids under powering the loudspeakers(s). Thus, depending on the power level of the audio signals on one (or more) of the signal paths, the individual loudspeakers within a given loudspeaker cluster can be automatically activated or deactivated (e.g., manually or automatically under control of the dynamics control module 90). Furthermore, a control signal embedded in the audio signal can identify the type of sound being delivered and thus trigger the precise group(s) of speakers, within a loudspeaker cluster, that most closely represents, the characteristics of that signal (e.g., actual directivity pattern(s) of the sound source(s) being reproduced). For example, if the sound source being reproduced is a trumpet, the embedded control signal would trigger a very narrow group of speakers within the larger loudspeaker network, since the directivity of an actual trumpet is relatively narrow. Similar control can occur for other characteristics.

The audio signals, if digital, preferably are encoded and decoded at a sample rate of at least 88.2 KHz and 20-bit linear quantitization. Other sample rates and quantitization rates can be used however.

The foregoing is not intended to limit the scope of the invention. The invention is only limited by the claims appended hereto.

The invention claimed is:

1. A sound system for capturing and reproducing sounds produced by a plurality of sound sources, comprising:

means for separately receiving sounds produced by the plurality of sound sources, wherein the plurality of sounds comprise a first sound produced by a first sound source, and a second sound produced by a second sound source that is separate and discrete from the first sound source;

means for converting the separately received sounds to a plurality of separate audio signals without mixing the audio signals such that the first sound is converted to a first sound signal and the second sound is converted to a second sound signal;

means for separately storing the plurality of separate audio signals to a single, non-transient, electronic storage medium without mixing the audio signals such that the first sound signal is stored to the electronic storage medium without mixing, and such that the second sound signal is separately stored to the electronic storage medium without mixing;

means for separately retrieving the stored audio signals from the electronic storage medium;

an amplification network comprising a plurality of amplifier means, with separate amplifier means for separately amplifying each of the separate audio signals, wherein the amplification network comprises a first amplifier means configured to amplify the first sound signal separate from the other sound signals, and wherein the amplification network further comprises a second amplifier means separate from the first amplifier means, the second amplifier means being configured to amplify the second sound signal separate from the other sound signals;

a dynamic controller configured to dynamically control the individual amplifier means separately from each other; and a loudspeaker network comprising a plurality of loudspeaker means, with separate loudspeaker means for reproducing the separately amplified audio signals without the separately amplified audio signals being mixed such that the first audio signal is reproduced by first loudspeaker means separately from the other amplified audio signals, and such that the second audio signal is reproduced by second loudspeaker means separately from the other amplified audio signals, the second loudspeaker means being separate and discrete from the first loudspeaker means.

2. The sound system of claim 1 wherein said separate loudspeaker means comprises one or more loudspeakers or groups of loudspeakers which are customized for reproduction of the type of sounds reproduced by each loudspeaker or group of loudspeakers.

3. The sound system of claim 1 wherein the dynamic controller is further configured to dynamically control the individual loudspeaker means in the loudspeaker network separately from each other.

4. The sound system of claim 1 wherein each of the plurality of sound sources comprises a group of individual sound sources.

5. The sound system of claim 1 wherein each of the amplification means is customized for the audio signals to be amplified by that amplifier means.

6. The sound system of claim 1 wherein the dynamic controller is configured to dynamically adjust individual ones of the amplification means based on one or more dynamic characteristics of the sounds represented by the audio signals.

7. The sound system of claim 2, wherein the customization of the loudspeakers includes one or more of the types of loudspeakers, the configuration of the loudspeakers, or the directionality of the loudspeakers.

8. The sound system of claim 1, wherein each amplifier means comprises a one or more amplifiers or groups of amplifiers which are customized for amplification of the type of audio signals to be amplified by each amplifier or group of amplifiers.

9. A sound system for recording and reproducing sounds produced by a plurality of sound sources, comprising:

means for separately receiving sounds produced by the plurality of sound sources, wherein the plurality of sounds comprise a first sound produced by a first sound source, and a second sound produced by a second sound source that is separate and discrete from the first sound source;

means for converting the separately received sounds to a plurality of separate audio signals without mixing the audio signals such that the first sound is converted to a first sound signal and the second sound is converted to a second sound signal;

a non-transient, electronic recording medium;

means for separately storing the plurality of separate audio signals on the recording medium without mixing the audio signals such that the first sound signal is stored to the electronic storage medium without mixing, and such that the second sound signal is separately stored to the electronic storage medium without mixing;

means for reading the stored audio signals from the recording medium and recreating the plurality of separate audio signals;

an amplification network comprising a plurality of amplifier means, with separate amplifier means for separately amplifying each of the recreated plurality of separate audio signals, wherein the amplification network comprises a first amplifier means configured to amplify the first sound signal separate from the other sound signals, and wherein the amplification network further comprises a second amplifier means separate from the first amplifier means, the second amplifier means being configured to amplify the second sound signal separate from the other sound signals;

a loudspeaker network comprising a plurality of loudspeaker means, with separate loudspeaker means for separately reproducing the amplified audio signals without the separately amplified audio signals being mixed such that the first audio signal is reproduced by first loudspeaker means separately from the other amplified audio signals, and such that the second audio signal is reproduced by second loudspeaker means separately from the other amplified audio signals, the second loudspeaker means being separate and discrete from the first loudspeaker means; and a dynamic controller for separately dynamically controlling the individual loudspeaker means in the loudspeaker network and the individual amplifier means in the amplification network according to predetermined control schemes that dictates adjustment of individual loudspeaker means and/or individual amplifier means based on changes in a characteristic of the received sounds reflected in the separate audio signals.

10. A system for reproducing sounds produced by a plurality of sound sources, comprising:

means for separately receiving a plurality of audio signals produced by the plurality of sound sources without mixing the audio signals, wherein the plurality of sounds comprise a first sound produced by a first sound source, and a second sound produced by a second sound source that is separate and discrete from the first sound source;

an amplification network comprising a plurality of amplifier means, with separate amplifier means for amplifying each of the plurality of audio signals, wherein the amplification network comprises a first amplifier means configured to amplify the first sound signal separate from the other sound signals, and wherein the amplification network further comprises a second amplifier means separate from the first amplifier means, the second amplifier means being configured to amplify the second sound signal separate from the other sound signals;

a dynamic controller configured to dynamically control the individual amplifier means separately from each other; and a loudspeaker network comprising a plurality of customized loudspeaker means, with separate loudspeaker means for separately reproducing each of the separately amplified audio signals without the separately amplified audio signals being mixed such that the first audio signal is reproduced by first loudspeaker means separately from the other amplified audio signals, and such that the second audio signal is reproduced by second loudspeaker means separately from the other amplified audio signals, the second loudspeaker means being separate and discrete from the first loudspeaker means.

11. The sound system of claim 10 wherein the dynamic controller is further configured to dynamically control the individual loudspeaker means in the loudspeaker network separately from each other.

12. The sound system of claim 10 wherein each of the plurality of sound sources comprises a group of individual sound sources.

13. The sound system of claim 10 wherein the dynamic controller is configured to dynamically adjust individual ones of the amplification means based on one or more dynamic characteristics of the sounds represented by the audio signals.

14. The sound system of claim 10 wherein said separate loudspeaker means comprise one or more loudspeakers or groups of loudspeakers which are customized for reproduction of the type of sounds reproduced by each loudspeaker or group of loudspeakers.

15. A method of recording and reproducing sound comprising the steps of:

capturing a plurality of sounds from a plurality of sound sources, wherein the plurality of sounds comprise a first sound produced by a first sound source, and a second sound produced by a second sound source that is separate and discrete from the first sound source;

converting each of the plurality of sounds to an audio signal such that the first sound is converted to a first sound signal and the second sound is converted to a second sound signal;

separately recording each of the audio signals to a single electronic storage medium such that the first sound signal is stored to the electronic storage medium without mixing, and such that the second sound signal is separately stored to the electronic storage medium without mixing;

separately retrieving each of the audio signals;

separately amplifying each of the plurality of audio signals, wherein the amplification of the separate audio signals is dynamically adjusted on a per-audio signal basis; and separately supplying each of the amplified audio signals to a loudspeaker network to reproduce the original plurality of sounds without the amplified audio signals being mixed such that the first audio signal is supplied to first loudspeaker means in the loudspeaker network separately from the other amplified audio signals, and such that the second audio signal supplied to second loudspeaker means separately from the other amplified audio signals, the second loudspeaker means being separate and discrete from the first loudspeaker means.

16. The method of claim 15 further comprising separately dynamically controlling individual loudspeaker means in the loudspeaker network.

17. The method of claim 15 wherein the amplification of the separate audio signals is dynamically adjusted based on a dynamic characteristic of the sounds represented by the audio signals.

18. The method of claim 16 wherein separately dynamically controlling individual loudspeaker means comprises dynamically adjusting individual loudspeaker means based on a dynamic characteristic of the sounds represented by the audio signals.

19. A method of sound reproduction comprising the steps of:

capturing a plurality of sounds from a plurality of sound sources, wherein the plurality of sounds comprises a first sound produced by a first sound source, and a second sound produced by a second sound source that is separate and discrete from the first sound source;

converting each of the plurality of sounds to an audio signal such that the first sound is converted to a first sound signal and the second sound is converted to a second sound signal;

separately transmitting each of the audio signals without mixing the audio signals such that the first sound signal is transmitted without mixing, and such that the second sound signal is separately transmitted without mixing;

separately amplifying each of the plurality of audio signals, wherein the amplification of the separate audio signals is dynamically adjusted on a per-audio signal basis; and separately supplying each of the amplified audio signals to a loudspeaker system to reproduce the original plurality of sounds without the amplified audio signals being mixed such that the first audio signal is supplied to first loudspeaker means in the loudspeaker network separately from the other amplified audio signals, and such that the second audio signal supplied to second loudspeaker means separately from the other amplified audio signals, the second loudspeaker means being separate and discrete from the first loudspeaker means.

20. The method of claim 19 further comprising separately dynamically controlling individual loudspeaker means in the loudspeaker network.

21. The method of claim 19 wherein the amplification of the separate audio signals is dynamically adjusted based on a dynamic characteristic of the sounds represented by the audio signals.

22. The method of claim 20 wherein separately dynamically controlling individual loudspeaker means comprises dynamically adjusting individual loudspeaker means based on a dynamic characteristic of the sounds represented by the audio signals.

* * * * *